United States Patent [19]

Epperson

[11] 4,035,873

[45] July 19, 1977

[54] CLIP FOR RENDERING A BOLA TIE USABLE AS A PENDANT

[76] Inventor: Lee W. Epperson, 4121 W. Palo Verde Drive, Phoenix, Ariz. 85019

[21] Appl. No.: 711,478

[22] Filed: Aug. 4, 1976

[51] Int. Cl.[2] ..... A41D 25/04

[52] U.S. Cl. ..... 24/49 S; 2/150; 24/49 P

[58] Field of Search ..... 24/49 S, 49 R, 49 P, 24/49 C, 52, 121, 129 R; 2/148, 149, 150, 152 R, 152 A, 153

[56] References Cited

U.S. PATENT DOCUMENTS

| | | | |
|---|---|---|---|
| 3,364,500 | 1/1968 | Fox | 2/150 |
| 3,675,277 | 7/1972 | Day | 2/49 S |
| 3,813,737 | 6/1974 | Larsen | 2/49 S |

*Primary Examiner*—G. V. Larkin

*Attorney, Agent, or Firm*—Warren F. B. Lindsley

[57] ABSTRACT

A detachable clip for bola tie together with a fixed cooperative means attached to the rear surface of the ornamental mount thereof for providing a quick and easy conversion of a bola tie to a chain-and-pendant arrangement with the common use of the ornamental portion of the bola tie.

9 Claims, 9 Drawing Figures

CLIP FOR RENDERING A BOLA TIE USABLE AS A PENDANT

BACKGROUND OF THE INVENTION

The rapid growth of the population centers in the Southwest and the growing numbers of winter visitors in the area have brought about an attendant rapid growth in popularity for Indian jewelry of all types including rings, necklaces, pendants, and, in particular, bola ties. Most of this jewelry is expensively made of precious metals and stones, incuding gold, silver and turquoise.

The bola tie has grown in popularity to the extent that it is now frequently seen in all parts of the U.S. In Arizona it is worn almost as frequently as the oridnary necktie and it has been recognized by the State legislature as the "official" neckware for the state.

The bola tie consists of a single, usually braided, cord having two free ends, and a clasp for drawing the cord together in front of the neck of the wearer, at about the location of the knot of a conventional necktie. At least one end of the cord is slidable through the clasp, so that the bola can be loosened for putting it on or taking it off or to tighten for wearing. Such ties can be worn in place of a conventional necktie with a buttoned collar or they may be worn loosely with a sport or a dress shirt with the collar unbuttoned. The means for securing or holding the ends of the cord together varies from very simple and usually not reliable loops of metal held only by frictional engagement against the cord, to elaborate lock systems which generally include spring tension or compression against each of the cord ends. Fastened to such locking means is usually a single decorative mount which varies from a simple polished stone to an elaborate silver and turquoise ornament.

As the bola tie has grown in popularity, the designs have become increasingly elaborate and expensive to the point that many now sell for several hundred dollars each, so that an investment in such a piece becomes a matter requiring careful consideration. One aspect of such considertion is the degree of versatility provided in the design. One might wish, for example, that it could be worn frequently for many types of occasions rather than for relatively limited special types of events.

It is to the provision of a greater degree of utility and versatility for such expensive bola tie ornaments that the present invention is addressed. Specifically, the invention provides a means for quicky and easily converting a bola tie to a pendant and the pendant back to the bola tie so that it may be worn appropriately by men or women in more than one manner.

DESCRIPTION OF THE PRIOR ART

Various means for fastening and clamping the bola ornamental mount to the cord have been employed. In general, such devices have been permanently attached to the ornament, but in one case, as described by E. F. Larsen in U.S. Pat. No. 3,813,737, a removable clasp is provided which permits the interchangeable attachment of any one of several ornaments to a single clasp and cord assembly. None of these arrangements was suitably contrived, however, to permit conversion of the ornamental part of the bola tie for alternate use as a pendant. Such conversion was not practical in the case of the Larsen arrangement for two reasons: First there was no provision made for attachment of the ornament to a chain, and second, the permanent part of the attachment means protruded excessively from the rear surface of the ornament to permit the confortable use of the ornment as a pendant.

SUMMARY OF THE INVENTION

In accordance with the invention claimed a simple and inexpensive means is provided for the quick and easy attachment or removal of the cord clamping arrangement from the rear of the bola ornament. Also provided at the top rear side of the ornament is an eyelet for attachment as a pendant to a chain.

It is, therefore, one object of this invention to provide an improved and more versatile assembly for a bola tie which permits the alternate use of the bola ornament as a pendant.

Another object of this invention is to provide such a versatile assembly which permits the quick and easy conversion from a bola tie to a pendant and back again without bending or excessively stressing any of the parts in a manner which could cause their premature failure.

A further object of this invention is to provide in such an assembly a capability for use with both four-ply and six-ply bola cords which have different thicknesses.

A still further object of this invention is to provide such an assembly in a form not employing any springs. A still further object of this invention is to provide such an assembly in a form in which the clasp or clamping device remains attached to the cord when removed from the pendant, this feature being provided to prevent loss of the clasp.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
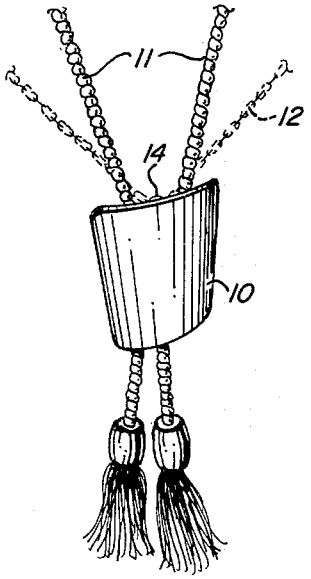
FIG. 1 is a perspective view of the versatile bola tie assembly of the invention with a chain attached to indicate the alternate use of the bola ornament as a pendant.

Referring more particularly to the drawings by characters of reference, FIG. 1 illustrates the versatile bola assembly of the invention and indicates the alternate use of the specially contrived bola ornament as a pendant to be supported from a chain. As shown in FIG. 1, the bola ornament 10, which preferably should have a concave rear side to provide room for a clip, may be adjustably attached to the bola cord 11 or it may be supported as a pendant from a separate body attachment means or chain 12.

Figure 2:
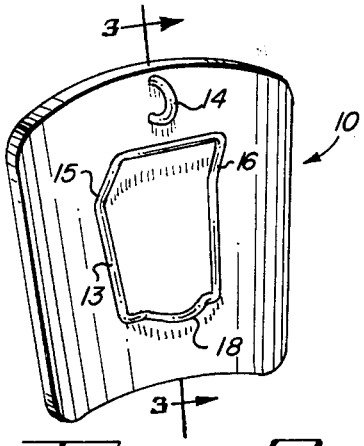
FIG. 2 is a perspective view of the rear side of the bola ornament with attached retaining wire for securing the bola clasp and with an attached eyelet or loop for connecting to a pendant chain.
Figure 3:
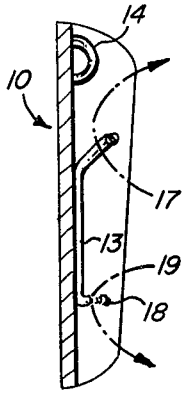
FIG. 3 is a cross-sectional view of the bola ornament of FIG. 2 as viewed along line 3—3 of FIG. 2.

Affixed by soldering or cement to the rear of ornament 10, as shown in FIGS. 2 and 3, is a retaining wire or frame 13 and a loop or eyelet 14. Frame 13 and eyelet 14 should have low profiles which enhances utility of the ornament 10 for use as a pendant.

The retaining wire frame 13 is shaped in the general form of a rectangular picture frame which is longer than it is wide and also somewhat wider at the top than at the bottom. It is attached along the lower two thirds of its two sides by soldering or cement to the rear surface of ornament 10 with frame 13 positioned approximately in the center of the rear surface of ornament 10. Approximately the upper third portion of frame 13 is inclined away from the rear surface of ornament 10 by virtue of a 30° to 45° bend in each of the side members of frame 13 at positions 15 and 16, these points lying roughly two-thirds of the way from the bottom to the top of frame 13. The inclination of the top of frame 13 away from the rear surface of ornament 10 forms a passage 17 between the upper portion of frame 13 and ornament 10. At the center of the lower member of frame 13 an arched bridge 18 extends perpendicularly from the surface of ornament 10 forming a second smaller passage 19 through the bridge 18.

The eyelet 14 is of a type commonly applied to the rear of pendants for attachment to chains. It is located at the top center of the rear of ornament 10 with its two legs attached one above the other along the centerline of the rear surface of ornament 10.

Figure 4:
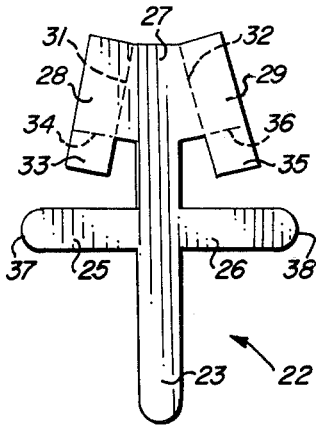
FIG. 4 is a plan view of a stamped metal part which is converted by bending and forming into a clasp member which may be used in cooperation with the bola ornament of FIGS. 2 and 3 to secure the bola cord.
Figure 5:
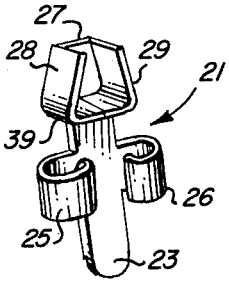
FIG. 5 is a perspective view of the clasp member made from the metal part of FIG. 4.

The frame or clasp member 21 shown in FIG. 5 is formed from a flat piece of metal 22 shown in FIG. 4. Piece 22 has its lower portion shaped in the form of a cross with lower vertical member or tab 23, upper vertical member 24 and horizontal arms 25 and 26. Projecting upward from the top of member 24 is a center wedge-shaped member 27 which supports at its tapered sides, members 28 and 29. The division between member 27 and members 28 and 29 are bending lines 31 and 32, respectively.

Tapered member 27 is nearly twice as wide at its lower end as at its upper end. Members 28 and 29 are elongated and rectangular. Member 28 is attached along approximately two-thirds of the length of one of its long edges to one of the tapered edges of member 27, the lower one-third of the length of member 28 extending beyond the lower extremity of member 27.

Member 29 is similarly attached to the opposite tapered side of member 27. A tab 33 comprising the extension of member 28 beyond the lower extremity of member 27 is separated from the remainder of member 28 by a transverse bending line 34. Similarly, a tab 35 is defined at the lower end of member 29 by a bending line 36.

To form the member 21 from piece 22, arms 25 and 26 are curled forward so that they will form recesses partially encircling the bola cord 11. The curved ends 37 and 38 of arms 25 and 26 stop short of completing a circle, however, so that the cord 11 may be forced in and out of these grips with moderate effort. Members 28 and 29 are bent forwardly at right angles along lines 31 and 32 and tabs 33 and 35 are then bent inward at right angles along lines 34 and 36, the members 28 and 29 and the tabs 33 and 35 thus forming a wedge shaped clamping means or block 39 smaller at the top than at the bottom.

To assemble the bola cord 11 with the clasp member 21 and the ornament 10, the cord 11 and the member 21 are first attached to each other. With clasp member 21 oriented as shown in FIG. 5, the block 39 directed upward, and with the loop of the cord 11 held upward, the two halves of the cord 11 are slipped into the encircling grips formed by members 25 and 26 of clasp member 21. Member 23 of clasp member 21 is then passed downward through passage 19 of ornament 10 as formed by the arch 18 of frame 13. Finally, the loop of cord 11 is passed upward through passage 17 and drawn tautly upward until the two sides of the cord 11 fall into position between the outer surfaces of block 39 and the inside surfaces of frame 13 as shown in FIG. 6.

When thus assembled, the cord is gripped between block 39 and the inside of frame 13, the projection of block 39 being of sufficient height to prevent its passing through passage 17. The gripping force applied to cord 11 is increased as wedge-shaped block 39 is forced upward and is released as block 39 is forced downward. During normal use as suspended by cord 11 around the wearer's neck, the weight of ornament 10 urges ornament 10 downward against the block 39 thereby sustaining the gripping pressure.

A simple and effective bola clasp is thus provided in the combination of the second frame member 21 and the first frame member 13 as attached to ornament 10. Each of the two parts 13 and 21 is of simple and inexpensive construction, each comprising a single member. Both the assembly of the cord 11 and clasp member 21 to the ornament 10 and their disassembly by the reverse procedure may be performed quickly and easily without the hazard of excessive wear, fatigue or damage to any of the parts. With the clasp member 21 and cord 11 removed, the ornament 10 may readily be suspended from a chain 12 utilizing the eyelet 14, the ornament 10 thus serving alternately as a pendant in accordance with the primary object of the invention.

Figure 6:
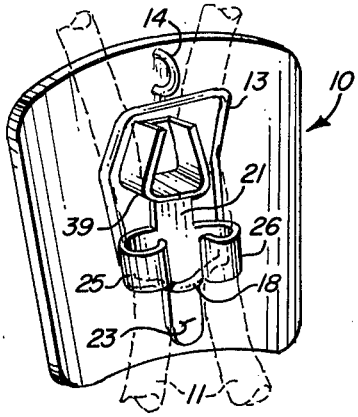
FIG. 6 is a perspective rear view of a first embodiment of the bola assembly of the invention employing the bola ornament of FIGS. 2 and 3 and the clasp member of FIGS. 4 and 5.
Figure 7:
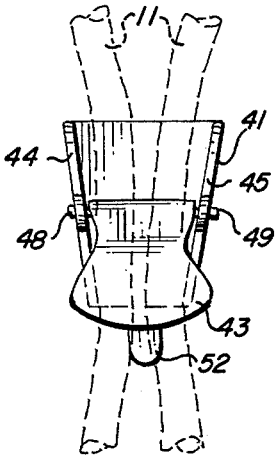
FIG. 7 is a front plan view of a second clasp configuration for a bola tie which has been adapted for use in this invention.
Figure 8:
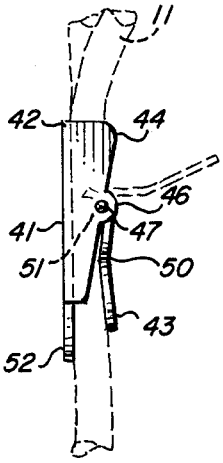
FIG. 8 is a side view of the clasp of FIG. 7.
Figure 9:
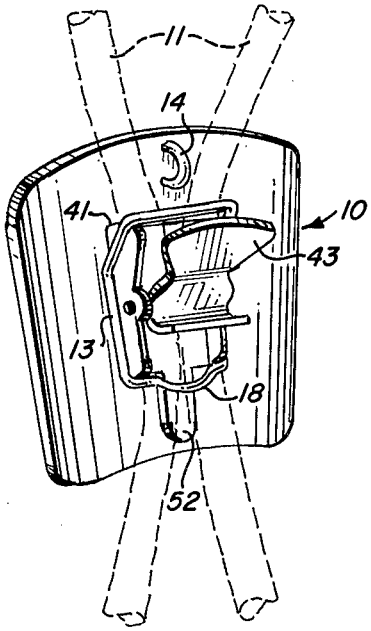
FIG. 9 is a perspective rear view of a second embodiment of the bola assembly of the invention employing the clasp of FIGS. 7 and 8.

In a second embodiment of the invention as illustrated in FIGS. 7, 8 and 9, a different type of clasp 41 is substituted for the clasp member 21 of FIGS. 4, 5 and 6.

The clasp 41 forming a second frame means is an adaptation of a commonly used clasp known as a Bennet clip. The Bennet clip is a two-part assembly including a channel-shaped body 42 and a pivoting clamping means or tab 43.

As shown in FIG. 7, the channel-shaped body 42 is typically wider at the upper end than at the lower end. The sides 44 and 45 of the body 42 are also tapered, being wider at the upper end. At the center of each of the sides 44 and 45 a semicircular projection 46 extends in the plane of the side member, and in the center of the projection 46 is a small circular hole 47.

The tab 43 is made from a flat piece of metal cut with a slight flare at the outer end and rounded at the outer edge to provide a comfortable grip to be grasped by the fingers. Near the opposite end there are two lateral projections, 48 and 49, one at each side which fit pivotally into the two holes 47. At the pivotal axis defined by tabs 48 and 49 the end of tab 43 is terminated in a short projection 51 which curls around the pivotal axis stopping just short of a 90° bend. The direction taken by the projection 51 is such that as the outer end of tab 43 is directed downward, the direction of the projection 51 is generally inward toward the body 42. Thus, when the cord 11 is passed through the clip 41, its two sides passing through the channel formed by body 42 and under the tab 43, the projection 51 is forced against the cord 11 as the tabs 43 is pivoted downward. The force of the projection 51 thus pinches the cord 11 and holds it in place. With the outer end of the tab 43 forced all the way downward, the projection 51 has moved past the point at which it was perpendicular with the edge of the cord so that the tab position is stabilized or locked and cannot come undone by itself. A slight outward bend 50 of the outer end of the main body of tab 43 aids in this locking action. The taper of body 42 with its wider upper end accommodates the spreading of the two halves of the cord 11 as they extend upward and outward to encircle the wearer's neck.

The adaptation of the Bennet clip for application in this invention includes two modifications: The first is the addition of a tab 52 extending downward from the lower end of the body 42. The second modification is the increased height of the channel sides 44 and 45 at the upper end of the body 42.

The utility of these modifications becomes apparent when the assembled cord 11 and clip 41 are attached to the ornament 10 as shown in FIG. 9. The procedure for attaching the ornament 11 to the clip 41 is essentially the same as in the case of the clip 21: The tab 52 of clip 41 is first passed downward through passage 19 of ornament 10. The looped end of cord 11 is then passed upward through passage 17 and drawn taut, whereupon the clip 41 falls into position inside the frame 13. Because of the height of the upper ends of the sides 44 and 45, the clip 41 is restrained from passing upward through the frame 13 while the cord 11 is held against the body of ornament 10 by the upper portion of frame 13. The combined actions of the tab 52, the sides 44 and 45, the frame 13 and the cord 11 thus secure the ornament 10 to the cord 11 and the clip 41.

It will be noted that in the first embodiment the tapered block 39 cooperated with the frame 13 to grip the cord while in the second embodiment the clip 41 provides the total cord gripping action without help from frame 13. Aside from this difference, however, the functions of the two embodiments are substantially the same, both conforming in all respects with the stated objects of the invention.

Although but two embodiments of the invention have been illustrated and described, it will be apparent to those skilled in the art that various changes and modifications may be made therein without departing from the spirit of the invention or from the scope of the appended claims.

What is claimed is:

1. A bola tie assembly which permits the bola tie ornament to be separately worn as a pendant comprising:

a bola ornament, a first frame means mounted on the back of said ornament and having two end members raised from the back surface of said ornament to each provide a passage for at least two end portions of a cord, a second frame means of a slightly smaller outer configuration than said first frame means arranged for a limited movement adjacent said first frame means, said second frame means having a tab extending outwardly of one of its ends longitudinally thereof, clamping means mounted on said second frame means for yieldably engaging and holding the two end portions of the cord a loop of which extends through the passage formed by one end of the first frame means and the ornament for surrounding the neck of a wearer of the bola tie, said second frame means being mountable within said first frame means by moving the tab of said second frame means outwardly of said ornament through the passage formed by the other end of said first frame means and said ornament until said second frame means can be juxtapositioned to said first frame means.

2. The bola tie assembly set forth in claim 1 wherein:

the second frame means is mountable substantially within the inner periphery of the first frame means.

3. The bola tie assembly set forth in claim 1 wherein:

said second frame means is parallelly arranged with said first frame means when said tab extends through the passage formed by the other end of said first frame means and said ornament.

4. The bola tie assembly set forth in claim 1 wherein:

said first frame means comprises a tapered configuration having a larger end defining a passage with the back surface of the ornament through which the loop of the cord extends, and a smaller end defining a passage with the back surface of the ornament through which said tab extends.

5. The bola tie assembly set forth in claim 1 wherein:

said first and second frame means each have tapered configurations, and said tab extends from the shorter end of the second frame means and extends out of the passage formed between the shorter end of said first frame means and the back surface of said ornament.

6. The bola tie assembly set forth in claim 1 wherein:

the back surface of said ornament defines a concave configuration.

7. The bola tie assembly set forth in claim 6 wherein:

the back surface of said ornament defines a concave configuration.

8. The bola tie assembly set forth in claim 1 in further combination with:

attachment means mounted on the back surface of said ornament for attachment to a separate body attachment means for wearing the ornament only as a pendant.

9. The bola tie assembly set forth in claim 1 wherein:

said second frame means comprises a base, means carried by said base defining a pair of recesses that open toward said base, a clamping member disposed between the base and each recess for clamping the cord portions one passing through each recess and the passage between said one end of said first frame means and the back surface of said ornament.

* * * * *